US006179172B1

(12) United States Patent
Elder et al.

(10) Patent No.: US 6,179,172 B1
(45) Date of Patent: Jan. 30, 2001

(54) CARGO DISCHARGE GATE

(75) Inventors: John B. Elder; Kirsten L. Sorensen, both of Belleville (CA)

(73) Assignee: EMS-Tech Inc., Belleville (CA)

( * ) Notice: Under 35 U.S.C. 154(b), the term of this patent shall be extended for 0 days.

(21) Appl. No.: 09/403,896

(22) PCT Filed: Mar. 9, 1999

(86) PCT No.: PCT/CA99/00204

§ 371 Date: Oct. 28, 1999

§ 102(e) Date: Oct. 28, 1999

(87) PCT Pub. No.: WO99/46187

PCT Pub. Date: Sep. 16, 1999

(30) Foreign Application Priority Data

Mar. 9, 1998 (GB) ..... 9804979
Jan. 20, 1999 (GB) ..... 9901257

(51) Int. Cl.[7] ..... B65D 90/66; B65D 27/22; B65D 35/30; B65D 90/62

(52) U.S. Cl. ..... 222/504; 251/58; 251/280

(58) Field of Search ..... 222/504; 251/279, 251/280, 58

(56) References Cited

U.S. PATENT DOCUMENTS 3,072,295 * 1/1963 Lovette ..... 222/504
3,414,312 * 12/1968 Garlinghouse ..... 222/504
3,556,358 * 1/1971 Armstrong ..... 222/504 X
3,589,670 * 6/1971 Armstrong ..... 251/58
3,716,266 * 2/1973 Garlinghouse ..... 294/71
3,998,426 * 12/1976 Isbester ..... 251/300 X
4,821,998 * 4/1989 Legille et al. ..... 251/58
4,945,949 * 8/1990 Carpentier ..... 251/58 X
5,241,989 * 9/1993 Kalavitis ..... 137/242 X
5,285,811 * 2/1994 DiLuigi et al. ..... 251/279 X

* cited by examiner

*Primary Examiner*—Kevin Shaver
*Assistant Examiner*—John Bastianelli
(74) *Attorney, Agent, or Firm*—Robert A. Wilkes

(57) ABSTRACT

A basket gate (18) mechanism, typically for use in the cargo holds (12), of bulk carriers (10), includes two opposed gate segments (50, 51) which shut along a central line. Each gate segment (50, 51) is supported at its ends by pairs of different length arms (57, 58, 59, 60), so that when the gate (18) is opened, the segments (50, 51) slope downwardly. The pairs of arms (57, 58, 59, 60) are interconnected by a small and compact direction reversing lever mechanism (61, 62, 63, 64) that ensures coordination of the movement of the segments (50, 51). The arms (57, 58, 59, 60) and the supporting framework (52) are protected by a hog back (53). The gate (18) is opened and closed by an actuating means (65), typically a double acting hydraulic cylinder, located between the gate segments (50, 51) at their midpoints, and directly acting on said said gate segments.

8 Claims, 8 Drawing Sheets

CARGO DISCHARGE GATE

BACKGROUND OF THE INVENTION

This invention relates to a bin, hopper or ship's cargo hold gate used in controlling the flow of a particulate material out of the bottom of the bin, hopper, or cargo hold.

The cargo spaces of ships adapted to convey particulate solids in bulk, generally known as bulk carriers, comprise a series of cargo holds which are in many ways similar to bulk bins or hoppers used in other applications to contain similar particulate solids. In this context, by "particulate solids" is meant any particulate solid material which is normally conveyed in bulk, in high volume; typical examples are crushed coal, many mineral ores including powdered sulphur, crushed rock, salt, fertiliser, saltpetre and various types of grain. These materials are well adapted to being moved about by continuous feed machinery, typically including the use of continuous belt conveyors, bucket elevators, and the like.

Although a bin or hopper can be emptied from the bottom with a gate mechanism relatively easily, in a bulk carrier emptying a cargo hold poses different problems. In a so-called "self unloading" bulk carrier, a discharge gate system is located in the bottom of each hold, which serves to control transfer of the particulate solids onto a first conveyor means located in a tunnel under the cargo holds. The conveyor moves the received solids along the tunnel, beneath the holds, to an elevator means which is generally at one end of the bulk cargo space, for example in the hull forecastle. The elevator moves the particulate solids essentially vertically, to a point from which they can be discharged from the ship, generally carried by a second conveyor means. In some self unloading bulk carriers the cargo compartments include two or three laterally spaced gate systems, together with the required tunnels and conveyers.

In many self unloading bulk carriers the discharge gate system comprises a row of centre opening gates, often described as "basket gates", generally located so that the axis of opening is along the length of the conveyor beneath the gate. The bottom of the hold is tapered downwardly to the (or each) row of gates to facilitate solids flow. The length of the gate opening can be up to 3 meters, and the open gate aperture can also be up to 2 meters wide. Each basket gate mechanism typically includes two opposed gate segments, and a hydraulic cylinder system to move the segments to open and to close the gate aperture; it is also possible to use linear electrically powered actuators or pneumatic cylinders instead of hydraulic devices. A feature common to all basket gates currently in use is that a gear mechanism is used to ensure that the gate segments move together and provide equal opening about the centre line of the gate opening. The gate has to be a substantial structure, as it has to support the load imposed by the cargo when closed, which also means that significant force can be required to open it, or to close it.

Although gate openings have increased in length and width, the construction of the so-called basket gate has hardly changed. Each gate is mounted between frames which support the ends of the gate segments, the gear mechanisms used to coordinate gate segment movement, and the hydraulic cylinders used to move them; other than at the ends of a row of basket gates, each frame generally supports the ends of two adjacent gates. The frames and mechanisms between each gate are supported by structures in the bottom of each cargo hold, and are protected by a covering structure, known as a hog back. But as the basket gate has grown larger, the space required for the gear mechanisms and the hydraulic systems has increased, thus requiring a larger hog back, to the detriment of the cargo holding space. Further, in the known basket gate, and in the known centre split roller track gate, the hydraulic system is arranged to act onto either the gear mechanisms, or the ends of, the gate segments directly, with the result that for each gate at least two, and often four, hydraulic cylinders are required, which both increases first cost and hydraulic installation complexity (especially if a remote control system is used) and requires significant maintenance.

A need therefore exists for a simpler, less complex, and more compact basket gate, which will occupy a smaller space within the cargo holds of a bulk carrier. Such a mechanism will have applicability more generally in other bulk holding bins and hoppers.

SUMMARY OF THE INVENTION

This invention seeks to provide such a mechanism. In the basket gate according to this invention, the system which operates to open and to close the two segments of the basket gate, which is typically a hydraulic system, is relocated to act directly on the segments themselves. This step simplifies significantly both the actuator required to move the gate segments (in a hydraulic system one double acting cylinder is usually sufficient), the control systems required, and also diminishes the amount of maintenance required. Although it is still necessary to coordinate gate segment movement so that the gate still opens about its centerline, far simpler mechanical arrangements can be used to do this, by interconnecting the basket gate linkage arms. Any mechanical linkage means can be used that will ensure coordinated movement by the two basket gate segments, such as a gear arrangement, or a lever arrangement. In a first detailed embodiment of this invention, cooperating gear means are provided at both ends of the basket gate between the linkage arms which each support one end of the two segments of the gate. In a second detailed embodiment of this invention, co-acting lever means are provided, which are placed into the basket gate segment linkage arms at both ends of the gate. The gate opening system, which is preferably a hydraulic system, is located substantially at the midpoint along the length of the gate, and acts directly between the two gate segments to open and to close the gate. Although a second hog back is required to protect the centrally located hydraulic system, the overall space requirements within the cargo space are diminished, since the supporting frames and the hog back needed to protect them are smaller, and the gate structure as a whole significantly simplified. Further, with the gate sizes currently in use it has been found that a single double acting hydraulic cylinder is sufficient to move both segments of a basket gate, thus also simplifying the required hydraulic system particularly if remote control is used. It is also contemplated that a similar arrangement can be used for a longer gate, with, for example, two cylinders each placed about a third of the distance along the gate opening and each protected by a small hog back. Alternatively, a single electrical linear actuator, or a pneumatic cylinder, can be used instead of a hydraulic cylinder.

Thus in its broadest embodiment this invention seeks to provide a basket gate having an aperture closed by two movable gate segments each having a first and a second end, comprising in combination:

- a first frame means adjacent a first end of the gate aperture;
- a second frame means adjacent a second end of the gate aperture;

a pair of first linkage means including pairs of linkage arms, the arms in each pair being rotatably attached at one end to the first frame means, and at the other end to each first end of the gate segments;

a pair of second linkage means including pairs of linkage arms, the arms in each pair being rotatably attached at one end to the second frame means, and at the other end to each second end of the gate segments;

a first co-operating mechanism in a co-operating relationship with each pair of first linkage means;

a second co-operating mechanism in a co-operating relationship with each pair of second linkage means;

at least one gate segment actuating means connected at a first end to the first gate segment, and at a second end to the second gate segment;

wherein the first and second co-operating mechanisms are constructed and arranged to coordinate the movement of the two segments when the gate is opened or closed by the gate actuating means, such that each gate segment moves substantially the same distance when the actuating means is actuated to open or to close the gate segments.

In a first more detailed embodiment this invention seeks to provide a basket gate having an aperture closed by two movable gate segments each having a first and a second end, comprising in combination:

a first frame means adjacent a first end of the gate aperture;

a second frame means adjacent a second end of the gate aperture;

a pair of first linkage means including pairs of linkage arms, the arms in each pair being rotatably attached at one end to the first frame means, and at the other end to each first end of the gate segments;

a pair of second linkage means including pairs of linkage arms, the arms in each pair being rotatably attached at one end to the second frame means, and at the other end to each second end of the gate segments;

a first gear means attached to the first linkage means in cooperating relationship with each pair of first linkage means;

a second gear means attached to the second linkage means in cooperating relationship with each pair of second linkage means;

at least one gate segment actuating means connected at a first end to the first gate segment, and at a second end to the second gate segment;

wherein the first and second gear means are constructed and arranged to coordinate the movement of the two segments when the gate is opened or closed by the gate actuating means.

Preferably, the gear means is located between one arm of a pair of arms attached to first gate segment, and the adjacent arm of a second pair of arms attached to the second gate segment. More preferably, the gear means comprises a first gear segment incorporated in one arm of a pair of arms attached to first gate segment; a first rotatable gear meshed with the first segment; a second rotatable gear meshed with the first gear; and a second gear segment attached to the adjacent arm of a second pair of arms meshed with the second gear.

In a second more specific embodiment this invention seeks to provide a basket gate having an aperture closed by two movable gate segments comprising a first and a second gate segment, each having a first and a second end, a closing face, and a rear face, comprising in combination:

a first frame means adjacent a first end of the gate aperture;

a second frame means adjacent a second end of the gate aperture;

a first linkage means, including two pairs of linkage arms providing a first and a second linkage arm in one pair, and a third and a fourth linkage arm in the other pair, the arms in each pair being rotatably attached at one end to the first frame means, and at the other end to the first ends of each of the two gate segments;

a second linkage means, including two pairs of linkage arms providing a fifth and a sixth linkage arm in one pair, and a seventh and an eighth linkage arm in the other pair, the arms in each pair being rotatably attached at one end to the second frame means, and at the other end to the second ends of each of the two gate segments;

a first co-acting lever interposed between the second and third linkage arms in the first pair, rotatably attached at one end to a first pivot on the second linkage arm between the attachments of the second linkage arm to the frame means and the gate segment end, and rotatably attached at the other end to a first extension carried by the third linkage arm extending away from the gate basket beyond the attachment of the third linkage arm to the frame means;

a second co-acting lever interposed between the sixth and seventh linkage arms in the second pair, rotatably attached at one end to a second pivot on the sixth linkage arm between the attachments of the sixth linkage arm to the frame means and the gate segment end, and rotatably attached at the other end to a second extension carried by the seventh linkage arm extending away from the gate basket beyond the attachment of the seventh linkage arm to the frame means; and at least one gate segment actuating means connected at a first end to the first gate segment, and at a second end to the second gate segment;

wherein the first and second co-acting levers are constructed and arranged to coordinate the movement of the two segments when the gate is opened or closed by the gate actuating means.

Preferably, the co-acting levers are arranged so that the first and second extensions are located on the same side of the basket gate opening. Alternatively, the co-acting levers are arranged so that the first and second extensions are located on opposite sides of the basket gate opening.

Preferably, the basket gate includes one actuating device, located substantially midway along the length of the gate segments between the supporting frames. More preferably, the basket gate includes one actuating device which is a double acting hydraulic cylinder. Most preferably, the actuating device is connected to the top sides of the first and second gate segments, and is protected by a hog back structure.

Preferably, within each pair of arms supporting the ends of the basket gate segments, the arms are of differing length so that the gate segments slope downwardly toward the gate opening when the gate is opened.

BRIEF DESCRIPTION OF THE DRAWINGS

The invention will now be described in more detail by way of reference to the drawings in which.

DESCRIPTION OF THE PREFERRED EMBODIMENTS

Figure 1:
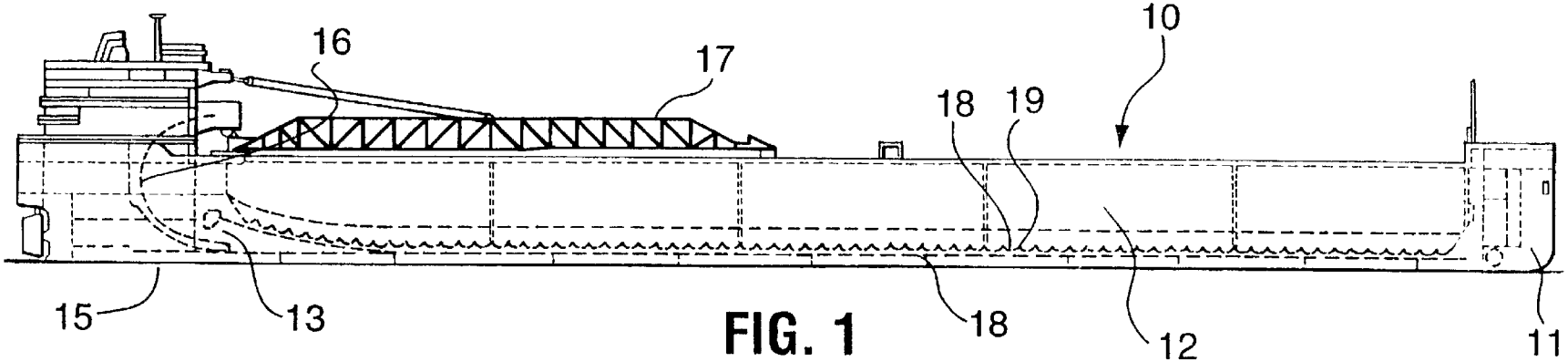
FIG. 1 shows the general layout of a bulk carrier.
Figure 2:
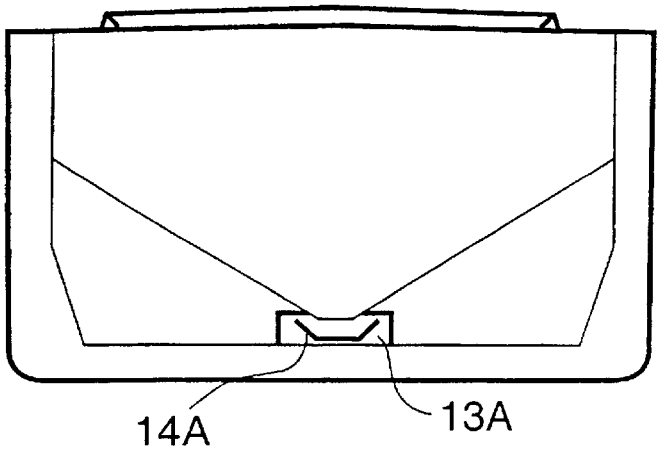
FIGS. 2 and 3 show typical hold cross sections.
Figure 3:
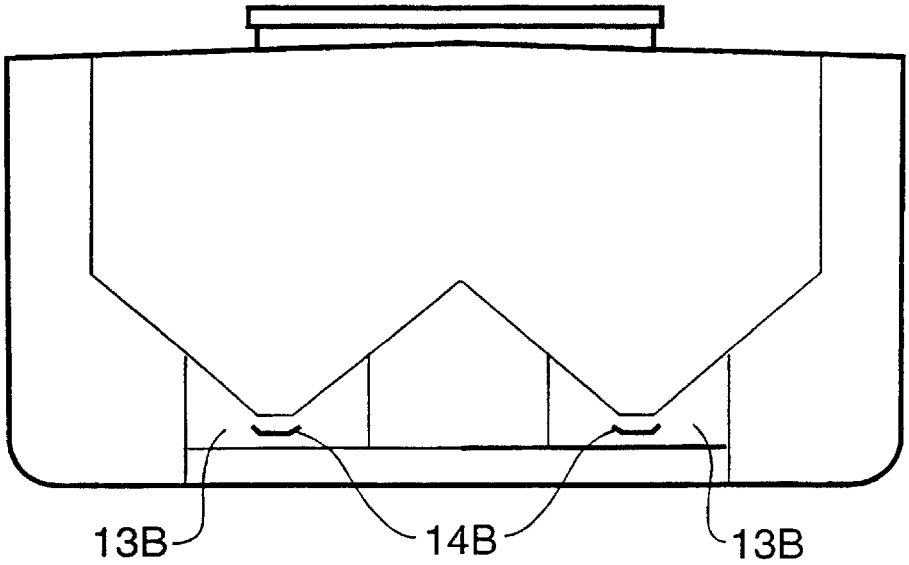

Referring first to FIG. 1, a typical bulk carrier 10 has a hull 11 which is divided into cargo holds 12, of which five are shown: the number of holds may be larger or smaller depending on the overall size of the ship. In the tunnel 13 below the holds is located a conveyor 14, which transports particulate cargo along the length of the holds. At its stern end 15 the solids are transferred to an elevator 16, and thence to a boom 17 incorporating a conveyor (not shown) for offloading the solids. In the example shown the elevator and boom are at the stern of the cargo section of the hull; they are also commonly installed as part of the forecastle. The holds of such a bulk carrier, as shown in the cross sections of FIGS. 2 and 3 may include one tunnel 13A and conveyor 14A as in FIG. 2, or more than one as shown at 13B and 14B in FIG. 3. Above the conveyor a sequence of basket gates 18 is located, with hog backs 19 to protect the mechanisms.

Figure 4:
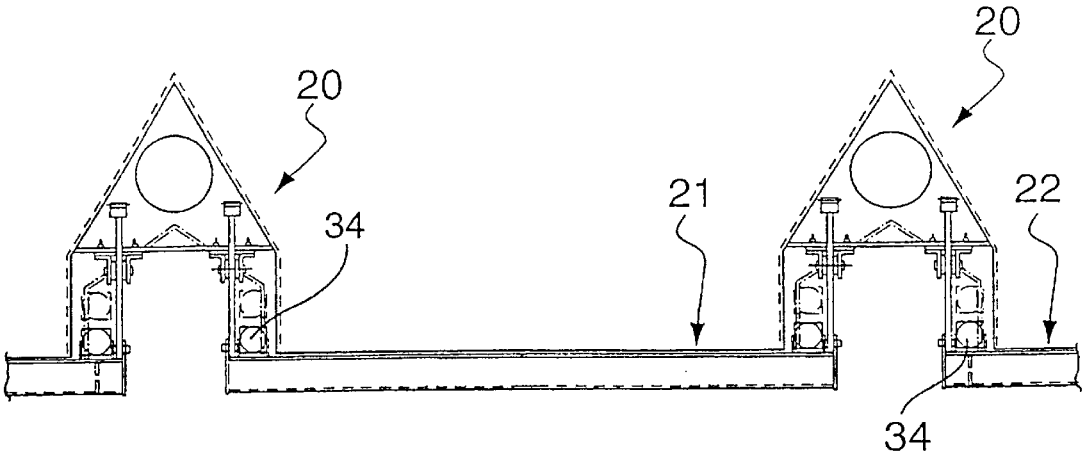
FIG. 4 PRIOR ART
FIGS. 4 and 5 show two views of a typical known gate construction.
Figure 5:
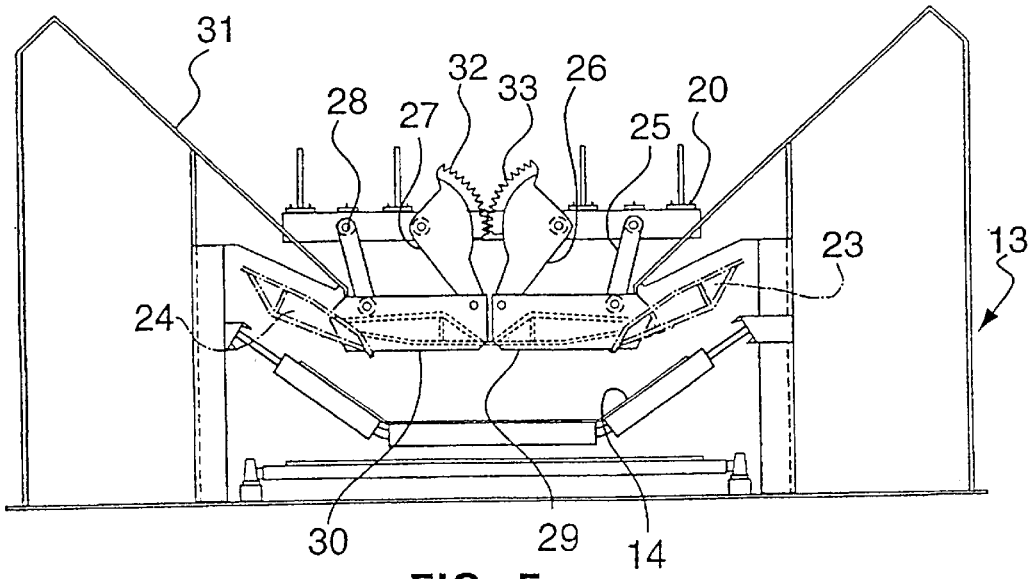
FIG. 5 PRIOR ART

In FIGS. 4 and 5 a typical known basket gate mechanism is shown; for clarity much of the supporting steel framing is omitted, and the hog back is omitted from FIG. 5. The basket gate is supported by the framing shown generally at 20; as shown one frame 20 supports the two adjacent ends of two basket gates 21 and 22. Each gate segment 23 and 24—shown ghosted in the open position in FIG. 4—is supported at each end by two pairs 25, 26 and 27, 28 of unequal length arms, attached to end plates 29, 30 on each gate segment, so that when closed the gate segments are more or less horizontal, and when open are angled downwardly so as not to obstruct solids flow, and to direct the solids flow onto the conveyor 14 in the tunnel 13, more or less following the slope of the lower part 31 of the hold. The arms 26 and 27 include integral gear segments 32, 33 which are meshed together, thus insuring that the gate segments move together.

The two gate segments are opened and closed by double acting hydraulic cylinders 34. In this construction, two cylinders are used, each acting on one end of each of the gate segments. The cylinders are attached at one end to a suitable location on one gate segment, while the other end is connected to a suitable point on the end of the other gate segment.

Figure 6:
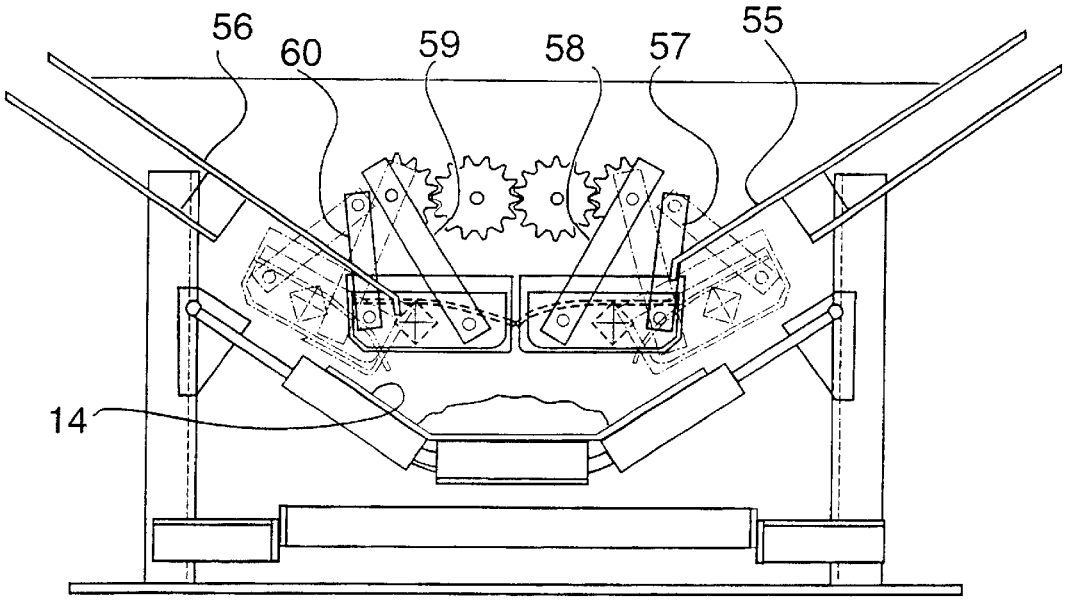
FIGS. 6, 7, 8, 9 and 10 show the construction of a gate according to the first embodiment of this invention.
Figure 7:
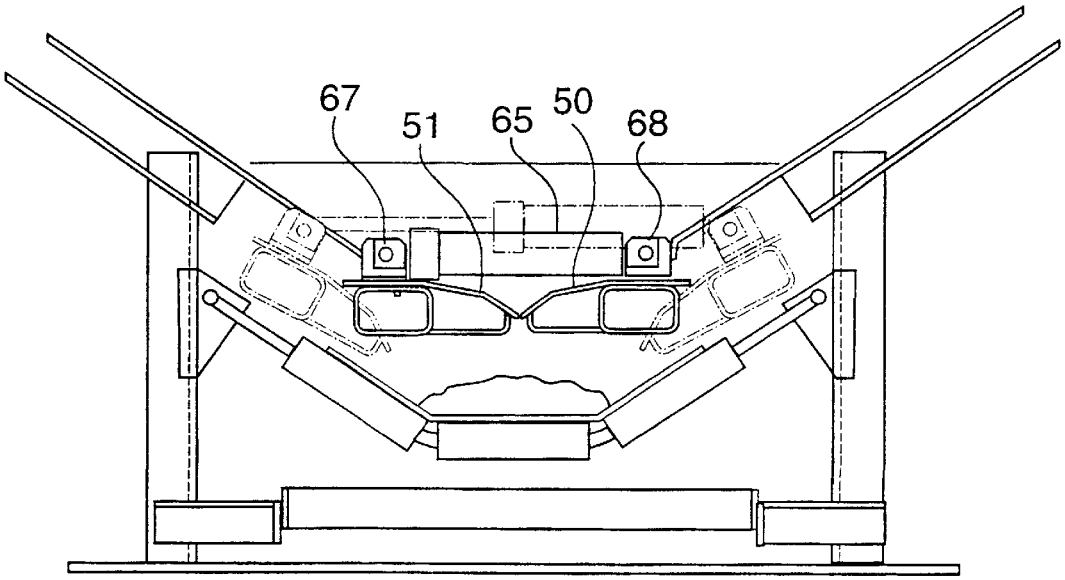

FIGS. 6, 7, 8, 9 and 10 show the construction of a basket gate according to this invention. As can be seen in FIGS. 6 and 7, each end of each of the two gate segments 50, 51 is supported by frames 52 protected by hog backs 53. As is the case with known basket gates, the gate segments 50, 51 when closed fit closely to projections 55, 56 of the hold bottom, and to the bottom edges of the hog backs. As shown in FIGS. 6 and 7, when the gate is opened, as the linkage pairs 57,58 and 59,60 are of unequal length, the gate segments move underneath the projections 55, 56 and also adopt a downwardly sloping angle to facilitate solids flow onto the conveyor 14.

Figure 8:
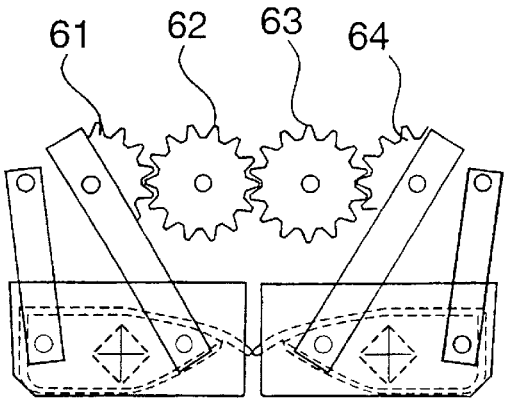

As shown in FIGS. 6 and 8, coordination of the movement of the two gate segments is obtained by the gear set comprising a first gear segment 61, a first gear 62, a second gear 63, and a second gear segment 64. As the gear set is meshed together in sequence, and all four are rotatably mounted onto the frame 52, rotation of the first gear segment 61 causes an equal and opposite rotation of the second gear segment 64. The use of this gear train also serves to minimise the space required for the gate. In theory the gear train could also be interconnected between the two outer arms in each pair, rather than between the two inner arms as shown. In practise construction of such an arrangement would be difficult, and would increase the overall size of the mechanism; for example, suitable rotational axis locations for the gears will be required which do not interfere with rotational movement of the inner arms in each pair as the gate is opened and closed.

Figure 9:
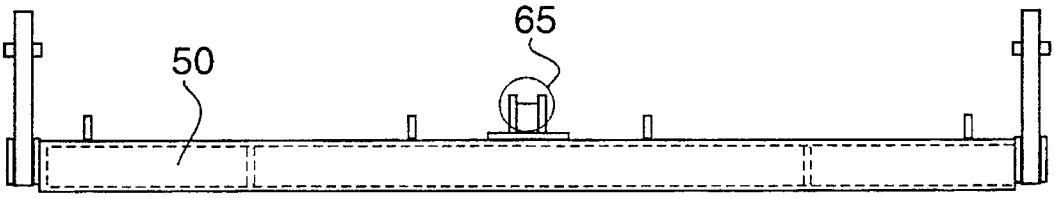
Figure 10:
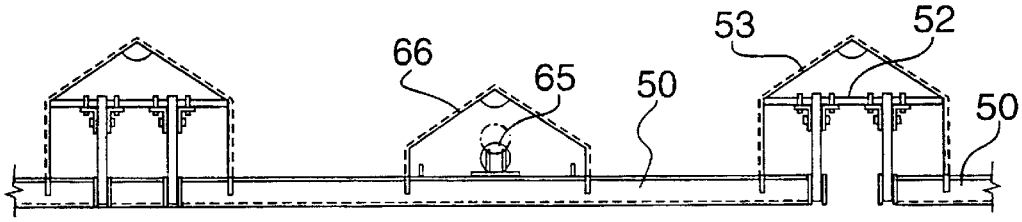
Figure 11:
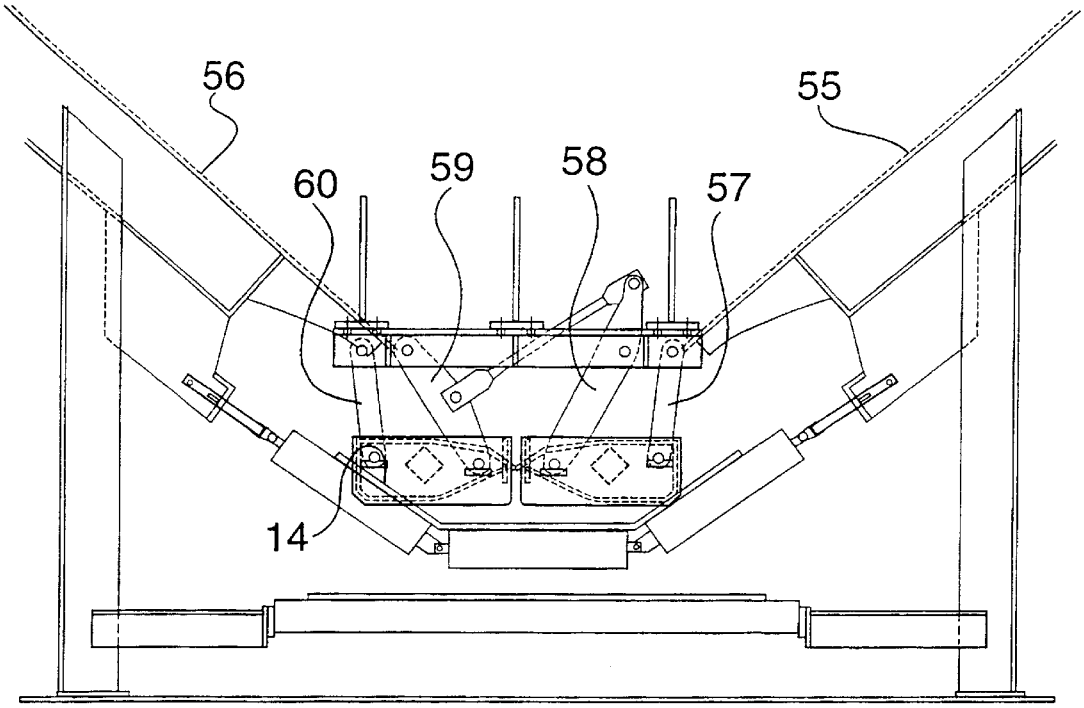
FIGS. 11, 12, 13, 14, 15 and 16 show the construction of a gate according to the second embodiment of this invention.

As shown in FIGS. 7, 9 and 10, the two gate segments are moved to open and to close the basket gate by a single actuator 65 located midway along the gate segments, and protected by its own hog back 66. As shown ghosted in FIG. 7, operation of this single device serves both to open and to close the gate segments. As shown, a single double acting hydraulic cylinder is used; this could be replaced with a linear electrical actuator, or a pneumatic cylinder, if desired. The cylinder is directly attached to the gate segments by rotatable pivot means 67 on gate segment 51, and by rotatable pivot means 68 on gate segment 50. Since only one double acting cylinder is used, with the cylinder case attached to one gate segment, and the piston attached to the other, the hydraulic system is greatly simplified. As shown, the cylinder is mounted onto the top side of the gate segments, and clearance is provided for it in the projections 55, 56. The cylinder can be controlled locally or remotely as is well known in the hydraulics art. An electrical linear actuator, or pneumatic cylinder, similarly can be controlled locally or remotely.

As can be seen by a comparison of FIGS. 4 and 10, both the gear mechanism and the supporting frames needed for the basket gate of this invention, and the associated hog back structure, are significantly smaller than those used hitherto. Further, the use of a single direct acting cylinder greatly simplifies the required hydraulic systems.

In the basket gate shown in FIGS. 6, 7, 8, 9 and 10 a single hydraulic cylinder is used. For the basket gates currently in use with an opening of up to 3 meters in length this appears to be sufficient. If the gate opening is lengthened significantly, more than one cylinder may become necessary. In that case it is preferred that the cylinders be equally spaced along the length of the gate segments; for example, if two cylinders are used they should be symmetrically located and separated by approximately a third of the length of the gate opening.

Figure 12:
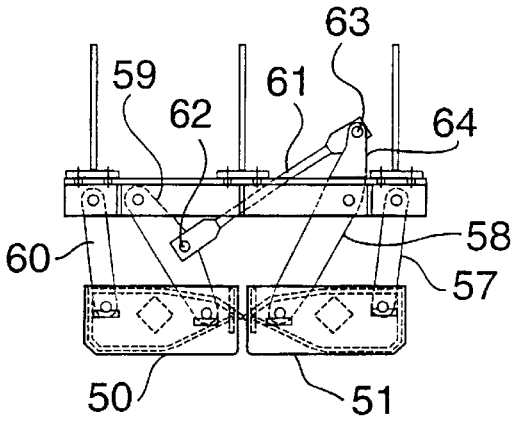

FIGS. 11, 12, 13, 14 and 15 show the construction of a basket gate according to the second embodiment of this invention. As can be seen in FIGS. 11, 12, 13 and 15, each end of each of the two gate segments 50, 51 is supported by frames 52 protected by hog backs 53. As is the case with known basket gates, the gate segments 50, 51 when closed fit closely to projections 55, 56 of the hold bottom, and to the bottom edges of the hog backs. As shown in FIG. 12 (gate closed), and FIG. 13 (gate opened), when the gate is opened, as the first, second, third and fourth arms making up the linkage pairs 57, 58 and 59, 60 are of unequal length, the gate segments move underneath the projections 55, 56 and also adopt a downwardly sloping angle to facilitate solids flow onto the conveyor 14. At the other end of the gate, a similar set of fifth, sixth, seventh and eighth arms is provided to support the other ends of the gate segments 50, 51.

Figure 13:
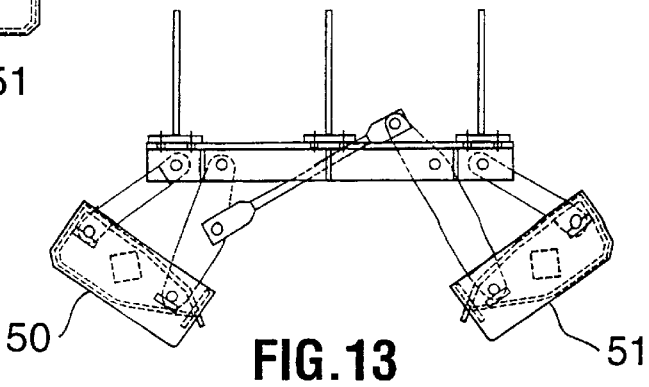

As shown in FIGS. 12 and 13, coordination of the movement of the two gate segments is obtained by the co-acting lever 61, which is attached between a first pivot point 62 on the second arm 59, and a rotatable attachment 63 at the distal end of the first extension 64, which in its turn is attached to, or is made integrally with, the third arm 58. Since the two rotatable attachments at 62 and 63 are located each side a line through the rotation points of the upper ends of the two pairs of arms 57, 58 and 59, 60, when the two gate segments are urged apart by the gate opening means, the co-acting lever 61 coordinates the movement of the two gate segments. A similar second co-acting lever is provided at the other end of the gate segments, and is located between a second pivot on the sixth arm, and a second extension on the seventh arm, thus coordinating the movement at both ends of the gate. The two extension arms can be located so that both of them are on the same side of the gate assembly, in which case two mirror image arm shapes are needed. Alternatively, the extension arms can be located one on each side of the gate assembly, in which case the same shape arm can be used for both ends of the gate. It is also possible to fabricate the extension arms so that they operate between the first and fourth arms, rather than between the second and third arms. Further, in theory it is possible to fabricate the extension arms so that, for example, they operate between the first and third arms. In practise this is possible for a gate in which all four arms are the same length, and the gate does not adopt a downward sloping position as it opens. It is more difficult for a gate in which the arms are of unequal length.

Figure 14:
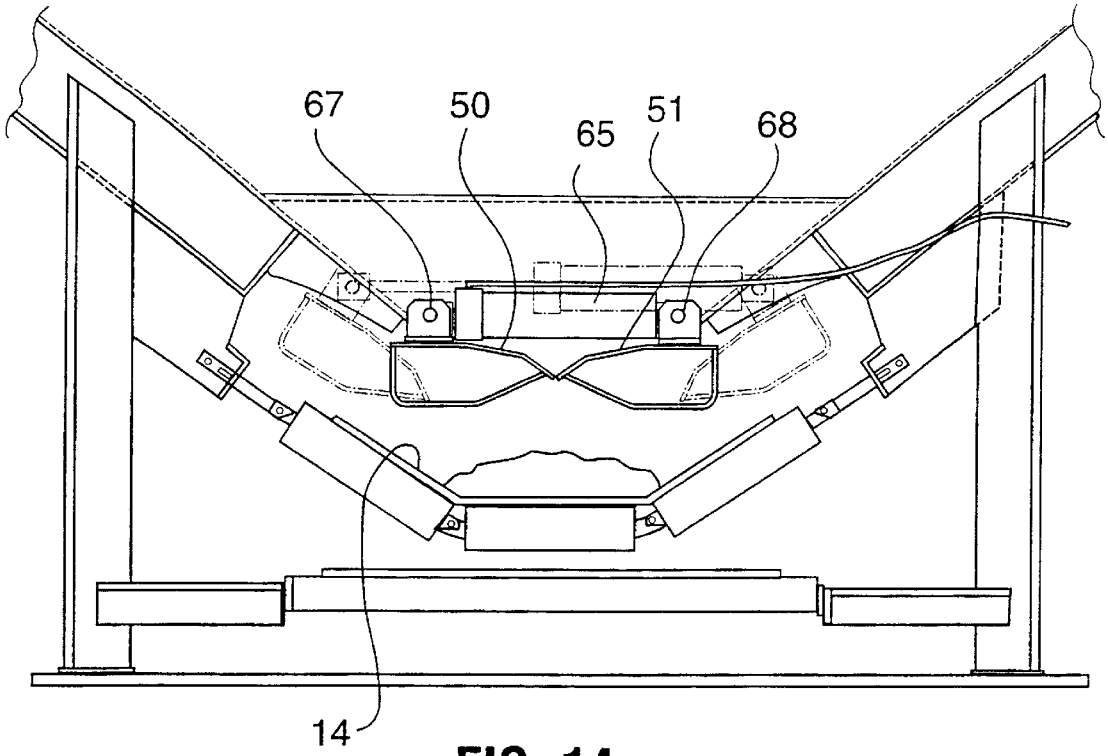
Figure 15:
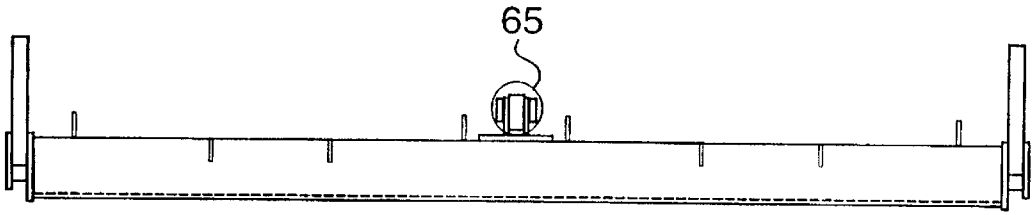
Figure 16:
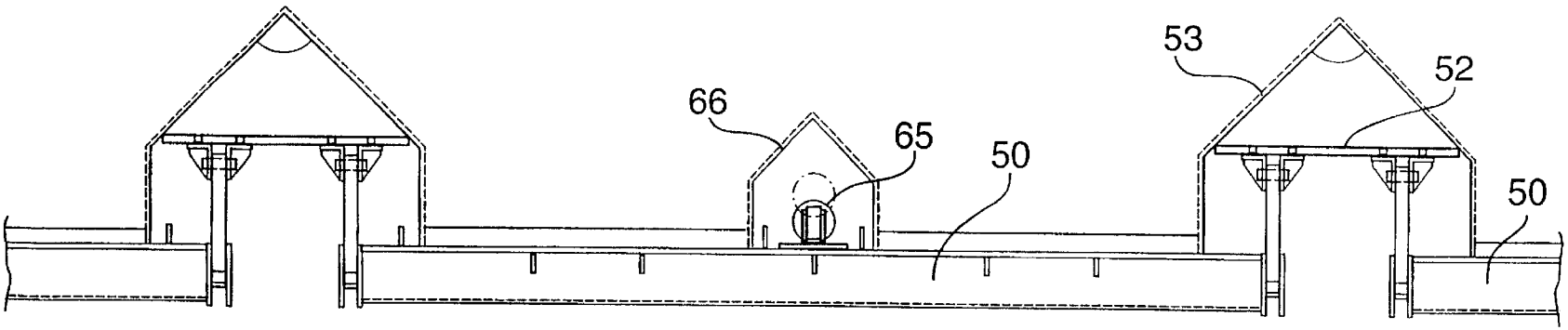

As shown in FIGS. 14, 15 and 16, the two gate segments are moved to open and to close the basket gate by a single actuator 65 located midway along the gate segments 50, 51, and protected by its own hog back 66. As shown ghosted in FIG. 14, operation of this single device serves both to open and to close the gate segments. As shown, a single double acting hydraulic cylinder is used; this could be replaced with a linear electrical actuator, or a pneumatic cylinder, if desired. The cylinder is directly attached to the gate segments by rotatable pivot means 67 on gate segment 51, and by rotatable pivot means 68 on gate segment 50. Since only one double acting cylinder is used, with the cylinder case attached to one gate segment, and the piston attached to the other, the hydraulic system is greatly simplified. As shown, the cylinder is mounted onto the top side of the gate segments, and clearance is provided for it in the projections 55, 56. The cylinder can be controlled locally or remotely as is well known in the hydraulics art. An electrical linear actuator, or pneumatic cylinder, similarly can be controlled locally or remotely.

As can be seen by a comparison of FIGS. 4 and 16, both the lever mechanism and the supporting frames needed for the basket gate of this invention, and the associated hog back structure, are significantly smaller than those used hitherto. Further, the use of a single direct acting cylinder greatly simplifies the required hydraulic systems.

In the basket gate shown in FIGS. 11, 12, 13, 14, 15 and 16 a single hydraulic cylinder is used. For the basket gates currently in use with an opening of up to 3 meters this appears to be sufficient. If the gate opening is lengthened significantly, more than one cylinder may become necessary. In that case it is preferred that the cylinders be equally spaced along the length of the gate segments; for example, if two cylinders are used they should be symmetrically located and separated by approximately a third of the length of the gate opening.

What is claimed is:

1. A basket gate having an aperture closed by two movable gate segments comprising a first and a second gate segment, each having a first and a second end, a closing face, and a rear face, comprising in combination:

a first frame means adjacent a first end of the gate aperture;

a second frame means adjacent a second end of the gate aperture;

a first linkage means, including two pairs of linkage arms providing a first and a second arm in one pair, and a third and a fourth linkage arm in the other pair, the arms in each pair being rotatably attached at one end to the first frame means, and at the other end to the first ends of each of the two gate segments;

a second linkage means, including two pairs of linkage arms providing a fifth and a sixth arm in one pair, and a seventh and an eighth arm in the other pair, the arms in each pair being rotatably attached at one end to the second frame means, and at the other end to the second ends of each of the two gate segments;

a first co-acting lever interposed between the second and third linkage arms in the first pair, rotatably attached at one end to a first pivot on the second linkage arm between the attachments of the second linkage arm to the frame means and the gate segment end, and rotatably attached at the other end to a first extension carried by the third linkage arm extending away from the gate basket beyond the attachment of the third linkage arm to the frame means;

a second co-acting lever interposed between the sixth and seventh linkage arms in the second pair, rotatably attached at one end to a second pivot on the sixth linkage arm between the attachments of the sixth linkage arm to the frame means and the gate segment end, and rotatably attached at the other end to a second extension carried by the seventh linkage arm extending away from the gate basket beyond the attachment of the seventh linkage arm to the frame means; and at least one gate segment actuating means connected at a first end to the first gate segment, and at a second end to the second gate segment;

wherein the first and second co-acting levers are constructed and arranged to coordinate the movement of the two segments when the gate is opened or closed by the gate actuating means.

2. A basket gate according to claim 1 including one gate actuating means, located substantially midway along the length of the gate segments between the supporting frames.

3. A basket gate according to claim 1 including one gate actuating means which is a double acting hydraulic cylinder.

4. A basket gate according to claims 1, 2 or 3 including one gate actuating means which is connected to the top sides of the first and second gate segments, and is protected by a hog back structure.

5. A basket gate according to claim 1 wherein each co-acting lever means is located between one arm of a pair of arms attached to the first gate segment, and the adjacent arm of a second pair of arms attached to the second gate segment.

6. A basket gate according to claims 1 or 5 wherein the co-acting levers are arranged so that the first and second extensions are located on the same side of the basket gate opening.

7. A basket gate according to claims 1 or 5 wherein the co-acting levers are arranged so that the first and second extensions are located on opposite sides of the basket gate opening.

8. A basket gate according to claim 1 wherein within each pair of linkage arms, the linkage arms are of differing length so that the gate segments slope downwardly toward the gate opening when the gate is opened.

* * * * *